US006598568B2

(12) United States Patent
Rosskamp et al.

(10) Patent No.: US 6,598,568 B2
(45) Date of Patent: Jul. 29, 2003

(54) TWO-STROKE ENGINE HAVING CHARGE STRATIFICATION

(75) Inventors: Heiko Rosskamp, Adelberg (DE); Markus Hahndorff, Aachen (DE)

(73) Assignee: Andreas Stihl AG & Co. (DE)

( * ) Notice: Subject to any disclaimer, the term of this patent is extended or adjusted under 35 U.S.C. 154(b) by 16 days.

(21) Appl. No.: 10/026,097

(22) Filed: Dec. 21, 2001

(65) Prior Publication Data

US 2002/0112681 A1 Aug. 22, 2002

(30) Foreign Application Priority Data

Dec. 22, 2000 (DE) ..... 100 64 719

(51) Int. Cl.[7] ..... F02B 33/04
(52) U.S. Cl. ..... 123/73 PP; 123/73 R
(58) Field of Search ..... 123/73 PP, 73 R, 123/73 B, 65 P, 73 BA, 74 B

(56) References Cited

U.S. PATENT DOCUMENTS 4,253,433 A 3/1981 Blair
6,016,776 A * 1/2000 Jonsson ..... 123/73 PP
6,257,181 B1 * 7/2001 Rosskamp et al. ..... 123/73 PP
6,267,088 B1 * 7/2001 Rosskamp et al. ..... 123/73 PP
6,367,432 B1 * 4/2002 Araki ..... 123/73 R
6,408,805 B2 * 6/2002 Uenoyama et al. ..... 123/73 PP
6,418,891 B2 * 7/2002 Kobayashi ..... 123/73 PP
6,427,647 B1 * 8/2002 Galka et al. ..... 123/73 PP
6,450,135 B1 * 9/2002 Araki ..... 123/73 B
6,460,494 B1 * 10/2002 Cobb, Jr. ..... 123/73 PP
6,491,005 B2 * 12/2002 Bergmann et al. ..... 123/73 PP

* cited by examiner

*Primary Examiner*—Henry C. Yuen
*Assistant Examiner*—Jason Benton
(74) *Attorney, Agent, or Firm*—R W Becker & Associates; R W Becker

(57) ABSTRACT

A two-stroke engine having charge stratification for portable, manually guided implements is provided. Formed in a cylinder is a combustion chamber that is delimited by a reciprocating piston that by means of a connecting rod drives a crankshaft in a crankcase. The combustion chamber has an exhaust port for exhaust gases and an intake port for rich mixture. The intake port forms one end of a feed channel, the other end of which opens into the crankcase. Between its ends, the feed channel is connected with a mixture-forming device. The crankcase has an air inlet for pure combustion air, which passes via a transfer channel from the crankcase into the combustion chamber. The intake port of the feed channel into the combustion chamber is, in the stroke direction of the piston, provided above the air inlet into the crankcase. At least a portion of the feed channel is embodied as an external component of the engine.

17 Claims, 4 Drawing Sheets

TWO-STROKE ENGINE HAVING CHARGE STRATIFICATION

BACKGROUND OF THE INVENTION

The present invention relates to a two-stroke engine, especially as a drive engine in a portable, manually guided implement such as a power chain saw, a brushcutter, a trimmer, a blower, a cut-off machine, or the like.

An engine of this type is disclosed in U.S. Pat. No. 4,253,433. The mixture path of the carburetor opens into a feed channel that opens into the combustion chamber approximately across from the exhaust port, with the other end of the feed channel being open to the crankcase. The crankcase has a diaphragm-controlled air inlet, whereby the feed channel is configured in such a way that only a small portion of the drawn-in rich mixture enters the crankcase. The feed channel is embodied as a curved channel that extends from the base region of the crankcase up to the combustion chamber. Such a channel is not capable of being die cast; it can be produced only in a complicated and expensive manner, and is therefore not very suitable for mass production.

It is therefore an object of the present invention to provide a two-stroke engine of the aforementioned general type that has a feed channel that is embodied in a more straightforward manner to allow an economical mass production of the engine.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figures 1A, 1B, 1C, 1D, 1E, 1F:
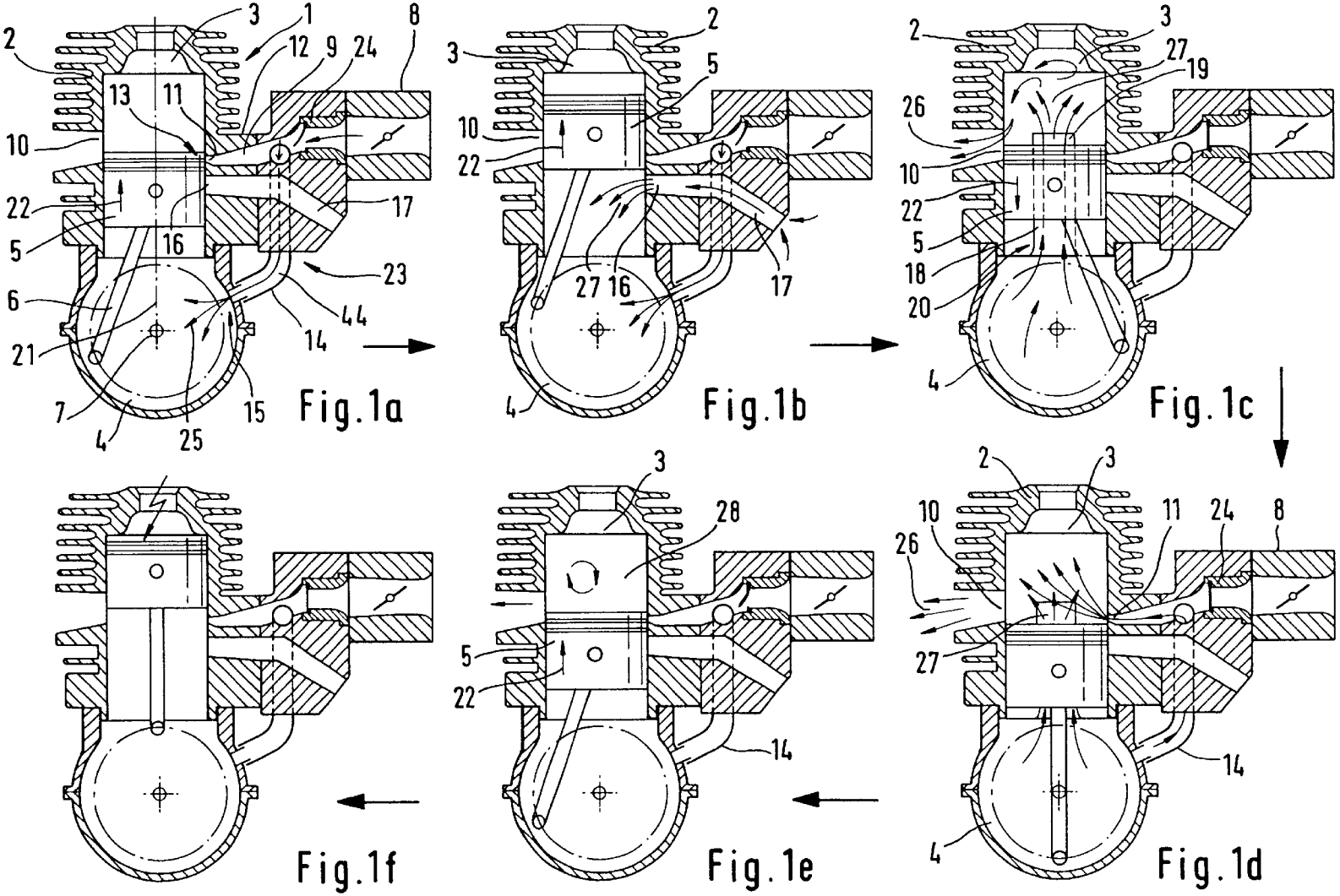
FIGS. 1*a* to 1*f* schematically illustrate the manner of operation of an inventive two-stroke engine over one operating cycle.

The two-stroke engine of the present invention comprises a cylinder in which is formed a combustion chamber that is delimited by a reciprocating piston, wherein by means of a connecting rod the piston drives a crankshaft that is rotatably mounted in a crankcase that is provided with an air inlet for combustion air, which passes from the crankcase into the combustion chamber via at least one transfer channel that at one end opens into the combustion chamber via a transfer window and at the other end communicates with the crankcase, wherein the cylinder is provided with an exhaust port for the discharge of exhaust gases from the combustion chamber and, approximately across from the exhaust port, with an intake port that forms one end of a feed channel that is provided for supplying a fresh mixture, wherein the other end of the feed channel opens into the crankcase, wherein the intake port opens into the combustion chamber and when viewed in a stroke direction of the piston toward an upper dead center position thereof, the intake port of the feed channel is disposed, in terms of height, above the air inlet to the crankcase; a mixture-forming device for a fuel/air mixture is provided, wherein between the ends thereof, the feed channel communicates with the mixture-forming device; also provided is a component that is external to the cylinder, wherein at least a portion of a feed channel is disposed in this component.

The intake port of the feed channel into the combustion chamber is, in the stroke direction of the piston, disposed above the air inlet, for which reason the supply of the mixture and of air is possible in a straightforward manner via a double-flow carburetor or the like. In this connection, a portion of the feed channel is formed as an external component of the engine, as a result of which the remaining channel portions are capable of being die cast, in other words, extend essentially radially, tangentially or axially relative to the cylinder axis.

Thus, the intake port of the feed channel into the combustion chamber is formed with an essentially linear, but also angled, intake portion in the cylinder connector that adjoins an intermediate portion of the feed channel that is provided in a carburetor flange. The carburetor flange is disposed between the cylinder and the mixture-forming device, and is fixedly connected to these components. The intermediate portion of the feed channel can establish the connection to an external tube that, as an external feed channel, is connected to the crankcase.

Pursuant to another embodiment of the present invention, the intermediate portion can also be embodied as an annular channel portion that enables connection of the tube below the air inlet on the carburetor flange. The effective length of the tube section can thus be significantly reduced.

It can be expedient to provide the annular portion as a connection between the intake portion and a housing channel that is embodied as an axial channel in the cylinder wall and opens into the crankcase.

The annular channel portion is preferably embodied as a complete ring, and is composed in particular of two annular grooves that are formed in mating end faces.

Further specific features of the present invention will be described in detail subsequently.

DESCRIPTION OF PREFERRED EMBODIMENTS

Referring now to the drawings in detail, the two-stroke engine 1 schematically illustrated in FIGS. 1*a* to 1*f* is used, in particular, as a drive engine in portable, manually guided implements such as power chain saws, brushcutters, trimmers, blowers, cut-off machines, etc.

The two-stroke engine 1 essentially comprises a cylinder 2 and a combustion chamber 3 that is delimited by a reciprocating piston 5. By means of a connecting rod 6, the piston 5 drives a crankshaft 7 that is rotatably mounted in a crankcase 4.

Exhaust gases that result in the combustion chamber 3 are discharged via an exhaust port 10 that is controlled by the piston 5. Provided approximately across from the exhaust port 10 in the cylinder wall is an intake port 11 that continues in an intake portion 9 of the cylinder connector 12. The intake port 11 forms one end 13 of a feed channel 14 that supplies fresh mixture; the other end 15 of the feed channel 14 opens into the crankcase 4. Between its ends 13 and 15, the feed channel 14 expediently communicates by means of a check valve 24 with a mixture-forming device 8 that is preferably embodied as a diaphragm carburetor having a Venturi portion. It can also be advantageous to connect the mixture-forming device 8 to the feed channel 14 via a piston/port control.

The crankcase 4 is furthermore provided with an expediently port or diaphragm controlled air inlet 16, which communicates with a combustion-supplying air channel 17. Furthermore, the crankcase 4 communicates via a transfer channel 18 (FIG. 1*c*) with the combustion chamber 3. For this purpose, one end of the transfer channel 18 opens via a transfer window 19 (FIG. 1*c*) into the combustion chamber 3, while the other end 20 is connected with the crankcase 4.

The cylinder 2 is capable of being die cast; all of the openings and channels provided in the cylinder, i.e. in the cylinder wall, can be formed by straight slides. The exhaust port 10, the intake portion 9, and the air channel 17 are essentially formed as channel portions that are disposed radially relative to the cylinder axis 21; these channel sections can also be disposed at an angle. With a port control, and in the stroke direction 22 of the piston 5, the intake port 11 of the feed channel 14 into the combustion chamber 3 is disposed, in terms of height, above the air inlet 16 into the crankcase 4. In this connection, the feed channel 14 is essentially formed as an external component 23 of the two-stroke engine 1. With a diaphragm controlled air inlet 16, a different position is also advantageous.

In the illustrated embodiment, the exhaust port 10, the intake port 11 and the air inlet 16 are controlled by the piston 5, in other words, are port controlled. The connection between the mixture-forming device 8 and the feed channel 14 is effected via the check valve 24, which can be embodied as a diaphragm valve; a port control can be advantageous.

In FIG. 1*a*, the piston 5 travels upwardly in the stroke direction 22, whereby the partial vacuum that exists in the crankcase 4 effects an intake or drawing in of a rich fuel/air mixture through the open check valve 24. The rich mixture flows into the feed channel 14, whereby the feed or storage volume formed in the feed channel 14 is at least 5% of the stroke volume of the two-stroke engine 1. The configuration is such that at nominal speed and full load, that amount of mixture is drawn into the feed channel 14 that approximately 5to 35% of the entire fuel mixture enters the crankcase 4, and thus contributes to the lubrication of the moving parts. This partial entering of the drawn-in mixture is indicated in FIG. 1*a* by the arrows 25. If the piston 5 moves further in the stroke direction 22 toward the upper dead center position, the air inlet 16 is opened (FIG. 1*b*). By means of the air channel 17, pure combustion air 27 flows into the crankcase 4. Although there is no need to add oil or fuel to the air intake, it may be advantageous to do so. The exhaust port 10 is closed, and the mixture that is disposed in the combustion chamber 3 is compressed and in the vicinity of the upper dead center position of the piston is ignited.

As shown in FIG. 1*c*, the piston 5 passes through the upper dead center position, whereby initially the exhaust port 10 is open, so that the exhaust gases 26 of the combustion can be discharged. Shortly after or even simultaneously with the opening of the exhaust port 10, the transfer window 19 is opened, as a result of which the volume of combustion air 27 temporarily stored in the crankcase 4 enters the combustion chamber 3 and displaces the exhaust gases toward the exhaust port 10. After further relief of the combustion chamber 3, the intake port 11 of the feed channel 14 is opened. Due to the downwardly traveling piston 5, in the stroke direction 22, near the lower dead center position (FIG. 1*d*) the crankcase volume is greatly compressed; when the intake port 11 is opened, the rich mixture that was temporarily stored in the feed channel 14 is displaced into the combustion chamber 3 due to the high pressure in the crankcase 4. A back or return flow to the mixture-forming device 8 is precluded due to the fact that the check valve 24 is closed.

Portions of the combustion air 27 entering the combustion chamber 3 essentially form the scavenging losses; furthermore, the rich mixture that enters via the intake port 11 is screened from the earlier entering combustion air relative to the exhaust port 10. Due to the flows that exist in the combustion chamber 3, the layered charge has a great swirling imparted thereto and during further compression by means of the piston 5 that is moving upwardly in the stroke direction 22 (FIG. 1*e*) forms a homogeneous mixture 28. During upward travel of the piston 5 in the stroke direction 22, there is again initially effected a drawing-in and temporary storage of a rich mixture in the feed channel 14, as was described in conjunction with FIG. 1*a*. Near the upper dead center position OT (FIG. 1*f*), ignition is then effected in the combustion chamber 3; the operating cycle then begins again.

The angular section Qα of the inlet of the feed channel is between 5and 25% of the total sum of angular sections of all transfer windows 19 of the transfer channels 18 and of the intake port 11 of the feed channel 14; the following equation is applicable for the angular section:

$$Q\alpha = \int_{\alpha Opening}^{\alpha Closing} A(\alpha)d\alpha$$

Figure 2:
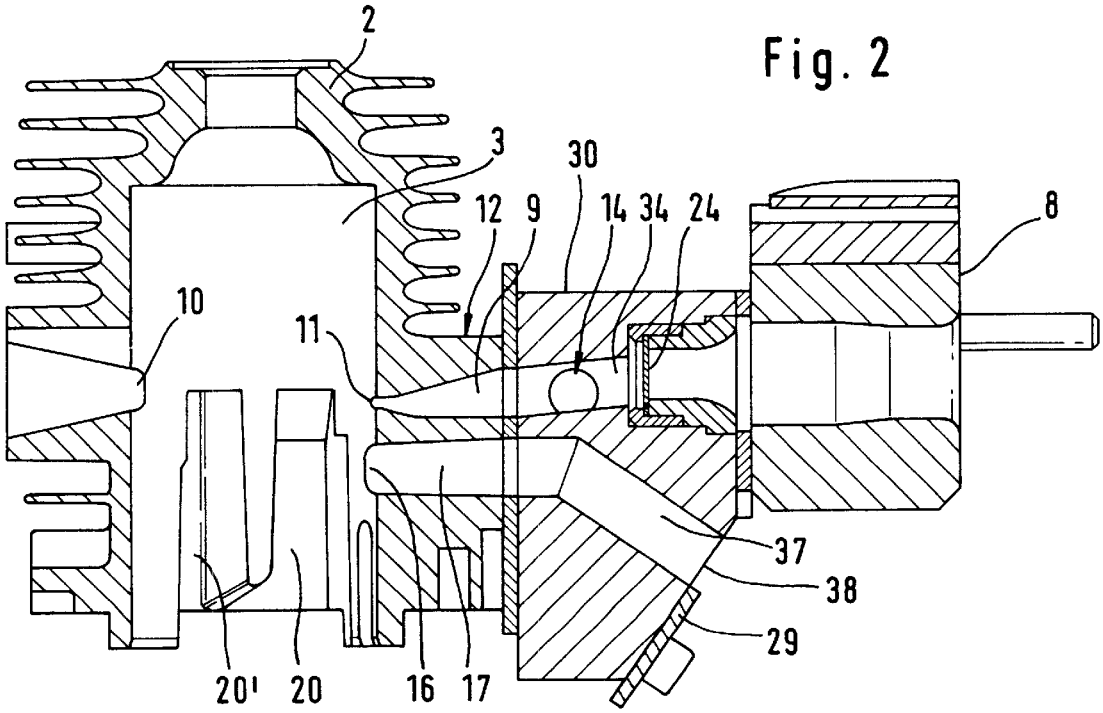
FIG. 2 is a partial cross-sectional view of a first exemplary embodiment of a cylinder having an external feed channel.
Figure 3:
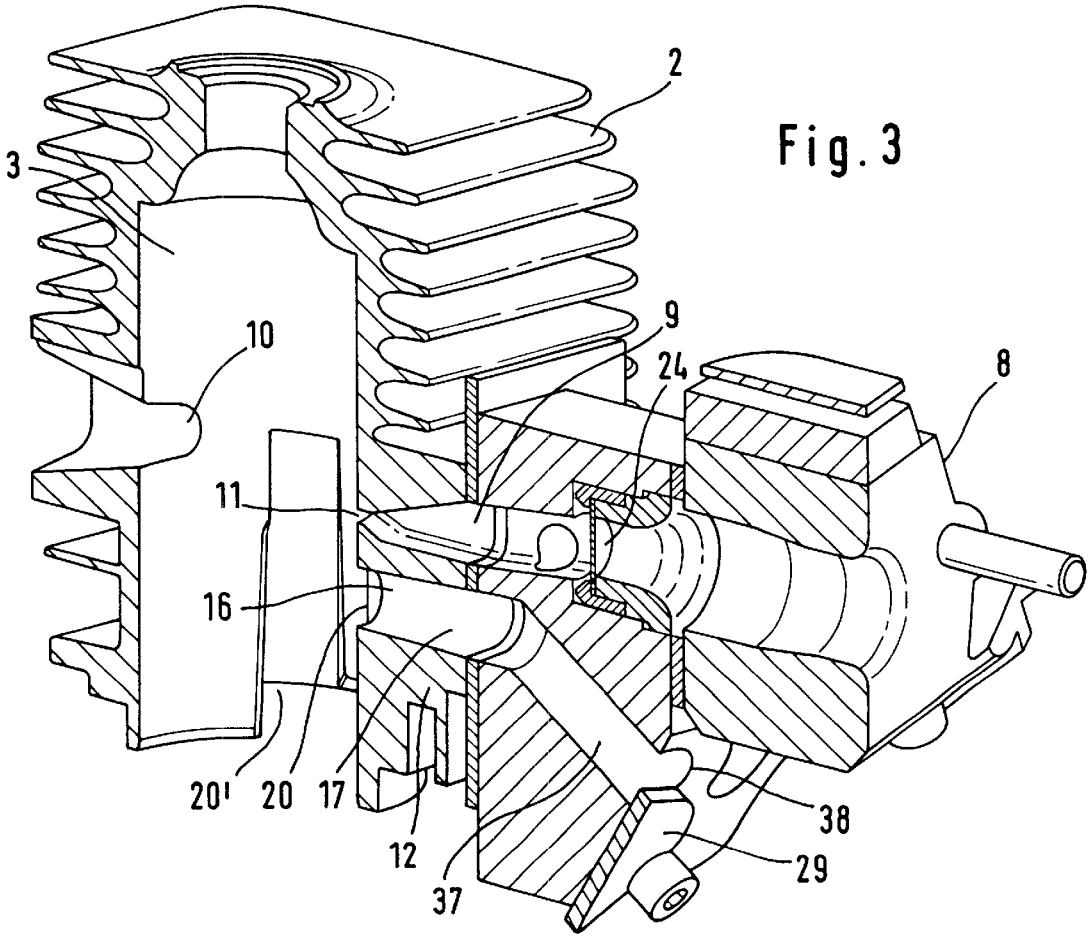
FIG. 3 is a partially cross-sectioned perspective view of the cylinder of FIG. 2 with an external feed channel.

As illustrated in FIG. 2, the intake port 11, together with an essentially linear intake portion 9 and the air inlet 16, as well as a portion of the air channel 17, are formed in the cylinder connector 12; in this connection, the intake portion 9 is tapered in the manner of a nozzle in a direction toward the intake port or window 11 and is advantageously sloped upwardly, away from the intake port, relative to the top of the combustion chamber. The configuration of the intake portion is expediently effected via an insert.

A carburetor flange 30 is provided for connecting the mixture-forming device 8 to the feed channel 14. The carburetor flange 30 is secured to the mixture-forming device 8, and, in addition to an intermediate portion 34 of the feed channel 14, is provided with a feed channel 37 as part of the air channel 17. Disposed at the feed opening 38 is a control valve 29 that can expediently be adjusted together with the butterfly valve of the mixture-forming device 8. In this connection the butterfly valve of the mixture-forming device 8, and the control valve 29 of the feed opening 38, can have different adjustment characteristics. The control valve 29 can be embodied as a butterfly valve in the tubular portion.

The intermediate portion 34 of the feed channel 14 has an outer connector to which is secured a tube section 44 (FIG. 1*a*), the other end of which is placed upon a connector of the crankcase 4.

Figure 4:
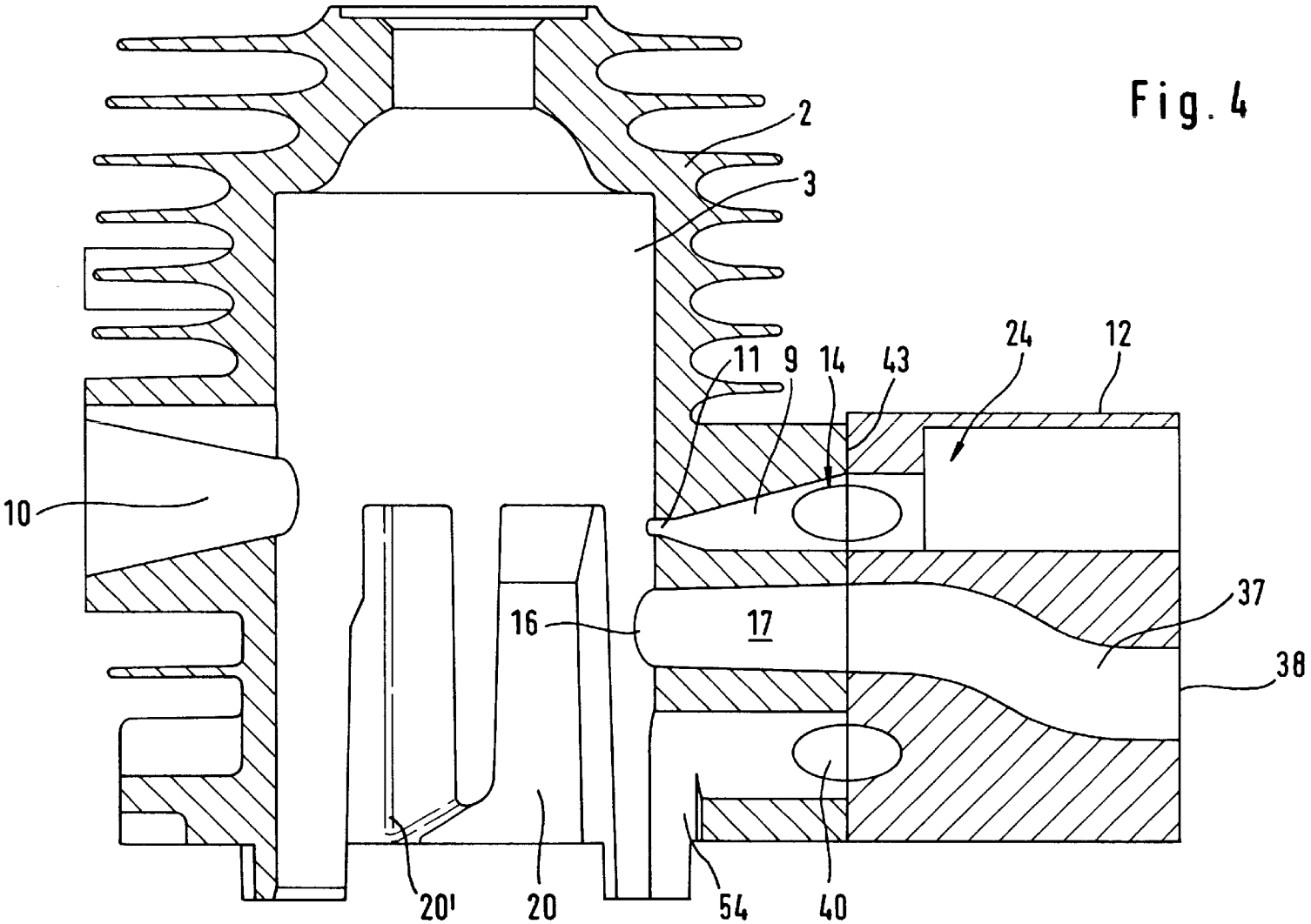
FIG. 4 is a cross-sectional view through a second exemplary embodiment of an inventive two-stroke engine having an external feed channel.
Figure 5:
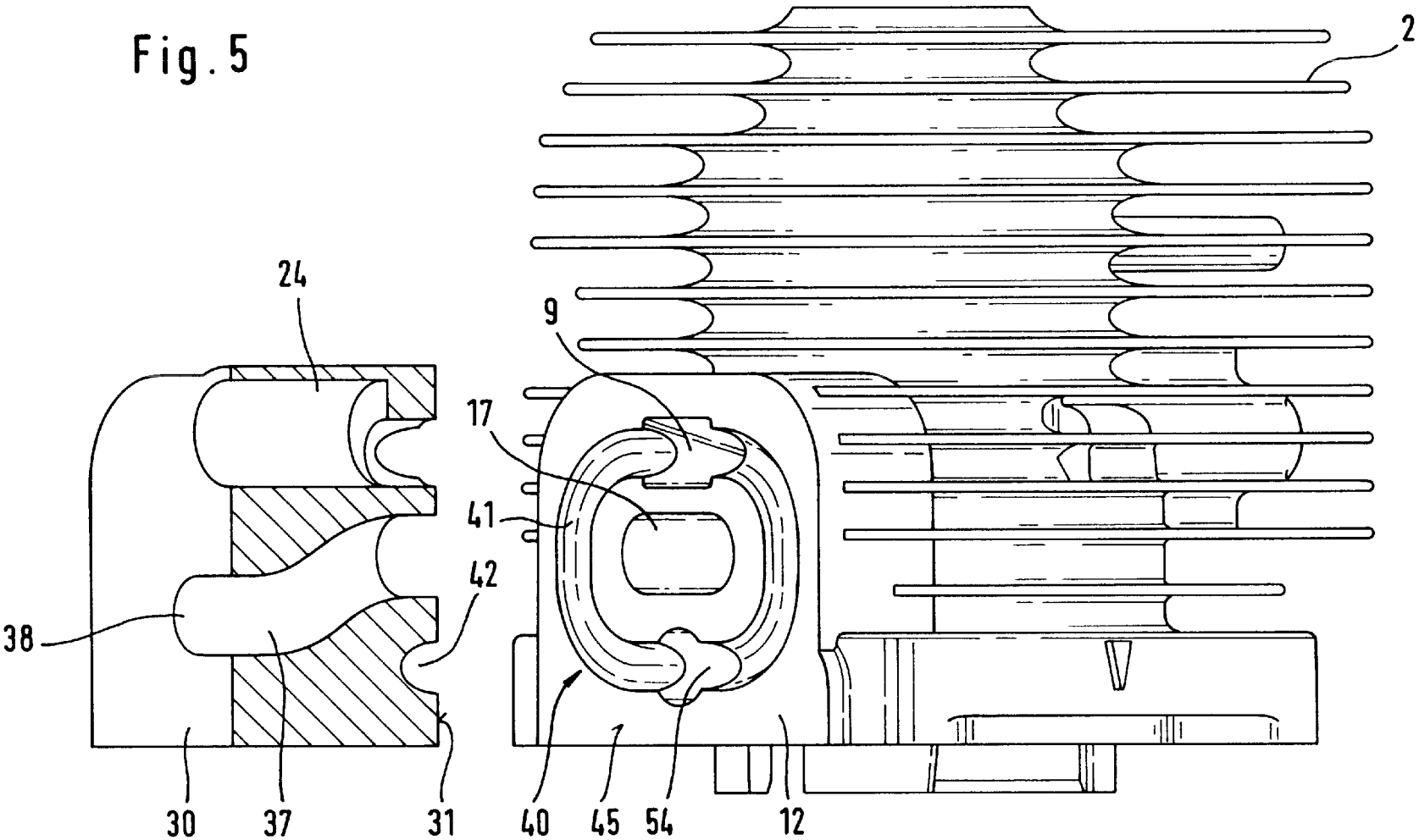
FIG. 5 is a perspective view of the cylinder of FIG. 4 with an external feed channel and an annular channel portion.

A further exemplary embodiment of the present invention is illustrated in FIGS. 4 and 5. The same components are provided with the same reference numerals.

To reduce the length of the outer connecting tube 44, it is proposed to connect the intake portion 9 to the tube section by means of an annular channel 40. In so doing, as shown in particular in FIG. 5, the annular channel 40 surrounds the air channel 17 in the cylinder connector 12. The annular channel 40 is expediently composed of two annular grooves 41, 42 whereby the plane of separation 43 advantageously corresponds to the sealing surface between the end face 45 of the cylinder connector 12 and the facing end face 31 of the carburetor flange 30.

Due to the configuration of the annular groove or channel 40, the feed channel 14 can advantageously also be embodied as a housing channel 54, as indicated in FIG. 4. The housing channel 54 can be configured as an axial channel that during die casting of a cylinder can be provided by a slide that is to be axially drawn.

The specification incorporates by reference the disclosure of German priority document 100 64 719.7filed Dec. 22, 2000.

The present invention is, of course, in no way restricted to the specific disclosure of the specification and drawings, but also encompasses any modifications within the scope of the appended claims.

We claim:

1. A two-stroke engine comprising:

a cylinder in which is formed a combustion chamber that is delimited by a piston that is reciprocatingly disposed in the cylinder, wherein by means of a connecting rod the piston drives a crankshaft that is rotatably mounted in a crankcase, wherein said crankcase is provided with an air inlet for combustion air, which passes from said crankcase into said combustion chamber via at least one transfer channel which at one end opens into said combustion chamber via a transfer window and at another end communicates with said crankcase, wherein said cylinder is provided with an exhaust port for the discharge of exhaust gases from said combustion chamber and, approximately across from said exhaust port, with an intake port that forms one end of a feed channel that is provided for supplying a fresh mixture, wherein another end of said feed channel opens into said crankcase, wherein said intake port opens into said combustion chamber and when viewed in a stroke direction of said piston towards an upper dead center position thereof, said intake port of said feed channel is disposed above said air inlet into said crankcase;

a mixture-forming device for a fuel/air mixture, wherein between said ends thereof, said feed channel communicates with said mixture-forming device; and a component that is external to said cylinder, wherein at least a portion of said feed channel is disposed in said external component.

2. A two-stroke engine according to claim 1, wherein a cylinder connector is provided and wherein said intake port together with an essentially linear intake portion, are formed in said cylinder connector.

3. A two-stroke engine according to claim 1, wherein a carburetor flange is disposed between said cylinder and said mixture-forming device, and wherein an intermediate portion of said feed channel is formed in said carburetor flange.

4. A two-stroke engine according to claim 3, wherein a supply channel for combustion air is formed in said carburetor flange and communicates with said air inlet.

5. A two-stroke engine according to claim 3, wherein said intermediate portion of said feed channel communicates with an external tube that establishes a connection of said feed channel with said crankcase.

6. A two-stroke engine according to claim 3, wherein said intermediate portion of said feed channel is embodied as a partial or complete annular channel that in particular surrounds an air supply channel for said crankcase.

7. A two-stroke engine according to claim 6, wherein said annular channel is composed of two annular grooves that are formed in mating end faces.

8. A two-stroke engine according to claim 7, wherein one of said annular grooves is provided in an end face of said carburetor flange.

9. A two-stroke engine according to claim 7, wherein one of said annular grooves is provided in an end face of a cylinder connector.

10. A two-stroke engine according to claim 4, wherein said carburetor flange is secured to said mixture-forming device and a control valve is disposed on a feed opening of said supply channel for combustion air.

11. A two-stroke engine according to claim 3, wherein said carburetor flange is provided with flow paths that extend essentially parallel for mixture and for combustion air.

12. A two-stroke engine according to claim 11, wherein said mixture-forming device is connected to a carburetor flange in which is disposed a check valve, and wherein a flow path of said mixture-forming device 8 is provided with a control valve.

13. A two-stroke engine according to claim 11, wherein said mixture-forming device is embodied as a double flow carburetor, an air path of which is in particular provided with a butterfly valve.

14. A two-stroke engine according to claim 1, wherein said feed channel has a volume that is at least 5% of a stroke volume of said two-stroke engine.

15. A two-stroke engine according to claim 1, wherein at nominal speed and full load approximately 5 to 35% of the entire fuel mixture enters said crankcase and contributes to lubrication.

16. A two-stroke engine according to claim 1, wherein an angular section Qα #11 of the intake port of the feed channel is approximately 5 to 25% of the total of the angular sections Qα #19 +Qα #11 of all transfer windows of the transfer channels and of said intake port according to the following equation:

$$Q\alpha = \int_{\alpha Opening}^{\alpha Closing} A(\alpha)d\alpha$$

whereby A (α) is a function of the area of said transfer window or said intake port in variation of the angle α of the crankshaft.

17. A two-stroke engine according to claim 1, wherein a control time of said feed channel is simultaneous with or later than a control time for said at least one transfer channel.

* * * * *